US005433225A

United States Patent [19]

Liggett et al.

[11] Patent Number: 5,433,225

[45] Date of Patent: Jul. 18, 1995

[54] SET OF HAIR COLORING INSTRUMENTS AND METHOD OF USE

[76] Inventors: Mark E. Liggett, 6824 Via Verano, Carlsbad, Calif. 92009; Louis B. Obertreis, 150 Cadmus St., Encinitas, Calif. 92024

[21] Appl. No.: 206,655

[22] Filed: Mar. 7, 1994

[51] Int. Cl.[6] ..... A61K 7/13; A45D 24/00; A45D 19/18

[52] U.S. Cl. ..... 132/208; 132/270; 132/200

[58] Field of Search ..... 132/200, 202, 208, 270, 132/212; 206/581, 823

[56] References Cited

U.S. PATENT DOCUMENTS

| | | | |
|---|---|---|---|
| 3,349,781 | 10/1967 | Poole et al. | 132/208 |
| 4,880,019 | 11/1989 | Roubo | 132/270 |
| 5,042,512 | 8/1991 | Knight | 132/212 |
| 5,146,937 | 9/1992 | LeFebvre | 132/208 |
| 5,349,970 | 9/1994 | Razzoug | 132/208 |

*Primary Examiner*—John G. Weiss
*Assistant Examiner*—Elise P. Speaks
*Attorney, Agent, or Firm*—Frank D. Gilliam; John R. Duncan

[57] ABSTRACT

A set of instruments for use in coloring selected groups of hair strands and a method of coloring hair using them. The instruments include a palette, a color board and a color blade. A layer of viscous hair coloring agent is placed on the color palette. A sheet of aluminum foil or the like is placed over the color board and folded over a beveled end of the color board. A group of hair strands to be colored is selected and placed on the a covered color board, with the beveled edge in contact with the scalp over a narrow line. A selected quantity of coloring agent is picked up by the color blade as a thin bead along the blade edge and brought into contact with the hair on the color board. The blade is moved along the hair to uniformly contact the hair with the coloring agent. The foil is then wrapped around the group of hair strands. Additional groups of hair strands can then be colored with the same or a different color. Preferably, the color blade has a flexible blade portion and a more rigid handle portion.

16 Claims, 2 Drawing Sheets

SET OF HAIR COLORING INSTRUMENTS AND METHOD OF USE

BACKGROUND OF THE INVENTION

This invention relates in general to the coloring of hair, in particular the localized coloring, and to a set of instruments for coloring selected groups of hair strands.

A very wide variety of devices, applicators and specialized containers have been developed for use in coloring human hair. Some simply color all of the hair uniformly, while others are capable of localized coloring of selected areas of the hair, selected groups of hair strands, etc. with varying degrees of effectiveness. All of the prior devices and methods have drawbacks that make them less than ideal.

Very large, powered, apparatus have been designed for uniform hair coloring, such as are described by Rudd in U.S. Pat. No. 3,575,181 and Anderson in U.S. Pat. No. 4,979,524. These devices are expensive, cumbersome, difficult to clean and tend to provide an unnatural looking uniform color to all or nearly all of the hair. They are not capable of providing natural appearing variations or highlights in the hair, or of performing frosting, tipping, etc.

Conversely, a number of very simple applicators have been developed, such as those described by Morganroth in U.S. Pat. No. 4,211,247, and Miya in U.S. Pat. No. 3,961,635. These applicators consist of a plastic squeeze bottle containing a hair coloring liquid with a nozzle for application and, in some cases, a brush, roller, or the like either incorporated into the nozzle or adjacent to the nozzle. The liquids used in these devices tend drip or spread beyond the desired application area. Dispensing a precise amount of the liquid is difficult, and if excess liquid is dispensed it cannot be returned to the bottle. Since the coloring agent is generally dispensed against hair against the scalp, the scalp surface may also be colored. Selecting a particular number of strands for coloring in an area is very difficult. These applicators are difficult to clean and would be expensive to dispose of after only a single use.

A hair clip hair coloring agent applicator is described by Busch et al. in U.S. Pat. No. 4,830,030. This device uses two rollers that contain a colorant in a sponge-like material (similar to stamp pad material) with the rollers spring-loaded toward each other. The rollers are moved apart, selected groups of hair strands are placed between the rollers which are released and moved along the hair. There is no control of how much coloring liquid is applied. Further, because of the diameter of the rollers, hair close to the scalp cannot be colored and attempts to color close to the scalp will bring the coloring liquid into contact with adjacent hair areas.

Thus, there is a continuing need for improved instruments for applying hair coloring agents to selected groups of hair strands which uses a more controllable coloring agent than the prior liquids, provides complete control over the number of strands colored and the amount of coloring agent used, permits coloring very close to the scalp without coloring the scalp and are easy to use and clean for re-use.

SUMMARY OF THE INVENTION

The above-noted problems, and others, are overcome in accordance with this invention, by a set of instruments which includes a color palette for holding a layer of viscous hair coloring agent, a color blade having a straight, somewhat flexible, edge for separating and lifting a selected quantity of coloring agent off of the palette and a color board to be placed under the selected hair strands and support them as the color blade is wiped along the hair strands, applying the coloring agent to the hair strands in a precisely controlled manner.

The color board preferably has a beveled edge for close contact with the scalp adjacent to the selected hair strands, to separate that group of strands from adjacent strands. Also, the color board is adapted to support a sheet of flexible foil as is used in the color weaving process. While any suitable foil may be used, aluminum foil is preferred because of low cost and ease of folding into a shape-retaining wrap.

Basically, the method of use of these instruments comprises applying a layer of coloring agent to the color palette, lifting a selected quantity of the coloring agent from the color palette with the color blade, placing the foil covered color board under a selected group of hair strands to be colored, initially holding those strands in place (typically with the thumb or fingers of the hand not holding the color blade) bringing the color blade into contact with the hair with the coloring agent in contact with the hair and firmly wiping the coloring agent along the hair away from the scalp. Once the blade contacts the hair, the hair no longer needs to be otherwise held in place. Generally, the color blade will be brought into contact with the color board close to the scalp, although for some frosting or tipping applications, contact may begin well away from the scalp. The foil is wrapped around the now-colored strands and the process is repeated with another group of strands, using the same or a different color.

BRIEF DESCRIPTION OF THE DRAWING

Details of the invention, and of certain preferred embodiments thereof, will be further understood upon reference to the drawing, wherein.

DETAILED DESCRIPTION OF PREFERRED EMBODIMENTS

Figure 1:
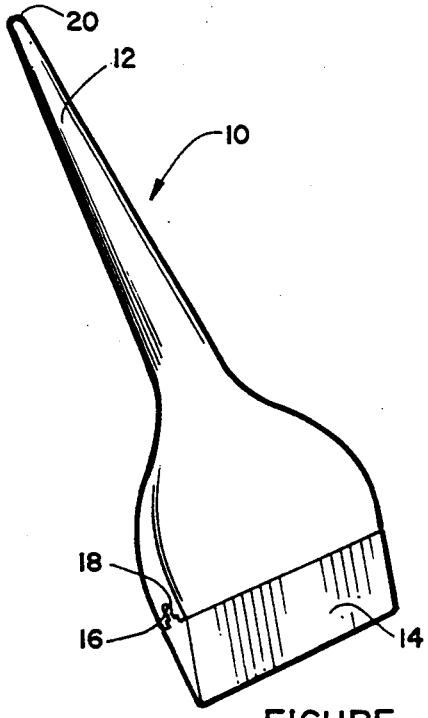
FIG. 1 is a perspective view of color blade of this invention.

As seen in FIG. 1, the color blade 10 includes a rigid handle 12 and a somewhat flexible blade portion 14. A circular cross section channel 16 is formed across the blade holding end of handle 12. The blade has a corresponding bead 18 that fits tightly in channel 16. Thus, the blade is easily removable and replaceable. The opposite end 20 of the color blade is preferably formed to a long tapered point.

Handle 12 may be formed from any suitable, generally semi-rigid, material. Typical of such materials are polyethylene and polypropylene. Blade portion 14 may be formed from any reasonably flexible material, such as plastics like or polyurethane or various flexible synthetic rubbers. Blade portion 14 should be sufficiently flexible to bend slightly and conform to a flat surface against which it is pressed while being sufficiently stiff to retain a reasonably straight edge shape when so pressed.

Bead 18 of blade portion 14 is preferably a fairly tight fit in channel 16 so as to keep the blade portion in place during use while allowing it to be slide out for removal when necessary. While the interlocking channel 16 and bead 18 arrangement is preferred for simplicity, ease of manufacture and ease of blade portion replacement, other fastening means could be used if desired.

Figure 2:
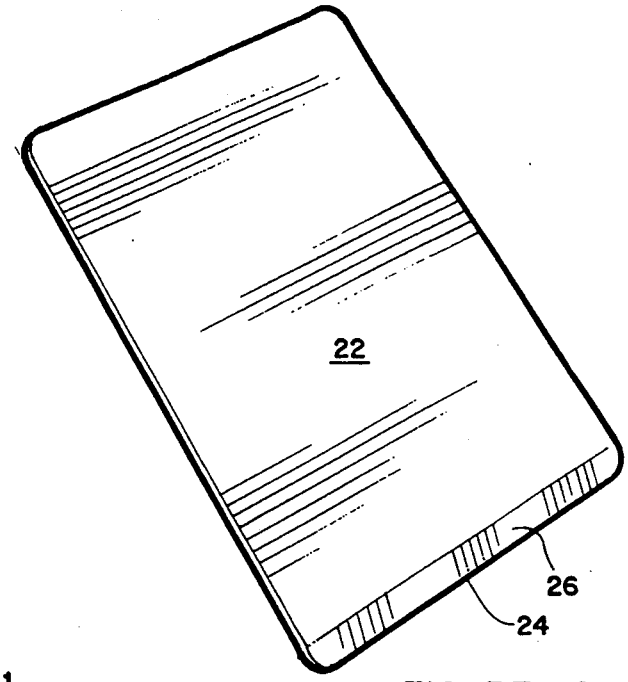
FIG. 2 is a perspective view of the color board used with the blade of FIG. 1.

FIG. 2 shows a color board 22 particularly adapted to cooperate with color blade 10. While a rectangular shape is preferred for ease of handling, other shapes may be used. However, the edge 24 to be used toward the scalp should be straight or slightly concave in shape to provide reasonably uniform contact with the scalp where the entire length of selected hair strands is to be colored. Edge 24 of color board 22 also preferably has a bevel 26 to permit the edge to contact a narrow line against the scalp to the maximum extent possible.

Figure 3:
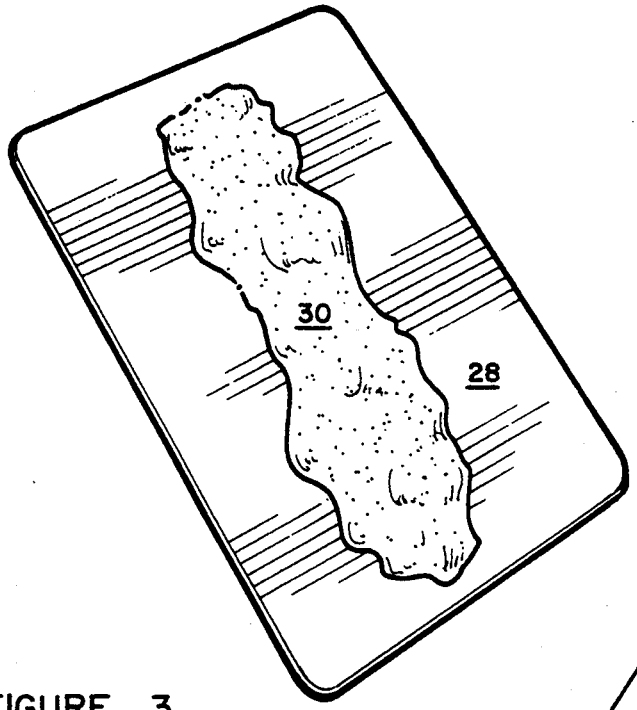
FIG. 3 is a perspective view of the color palette used with the blade of FIG. 1.

A color palette 28, as seen in FIG. 3, carries a layer of coloring agent 30. While color palette 28 may have any suitable shape, a generally rectangular shape, having a width somewhat greater than the width of blade portion 14 of color blade 10 is preferred. The viscous coloring agent should have a sufficiently thick consistency to stay in place on palette 28 and not run even when the palette is tipped. The layer may have any suitable thickness. Typical viscous coloring agents which have long been available commercially include the lines of different colored agents available under "Shades EQ" designation from the Redken Company and from the Wella Company, the "Presentation" "Color Perfect" and "Fashion Frost" lines. At least two of these, of different colors, may be applied separately to different areas of the hair as desired.

Figure 4:
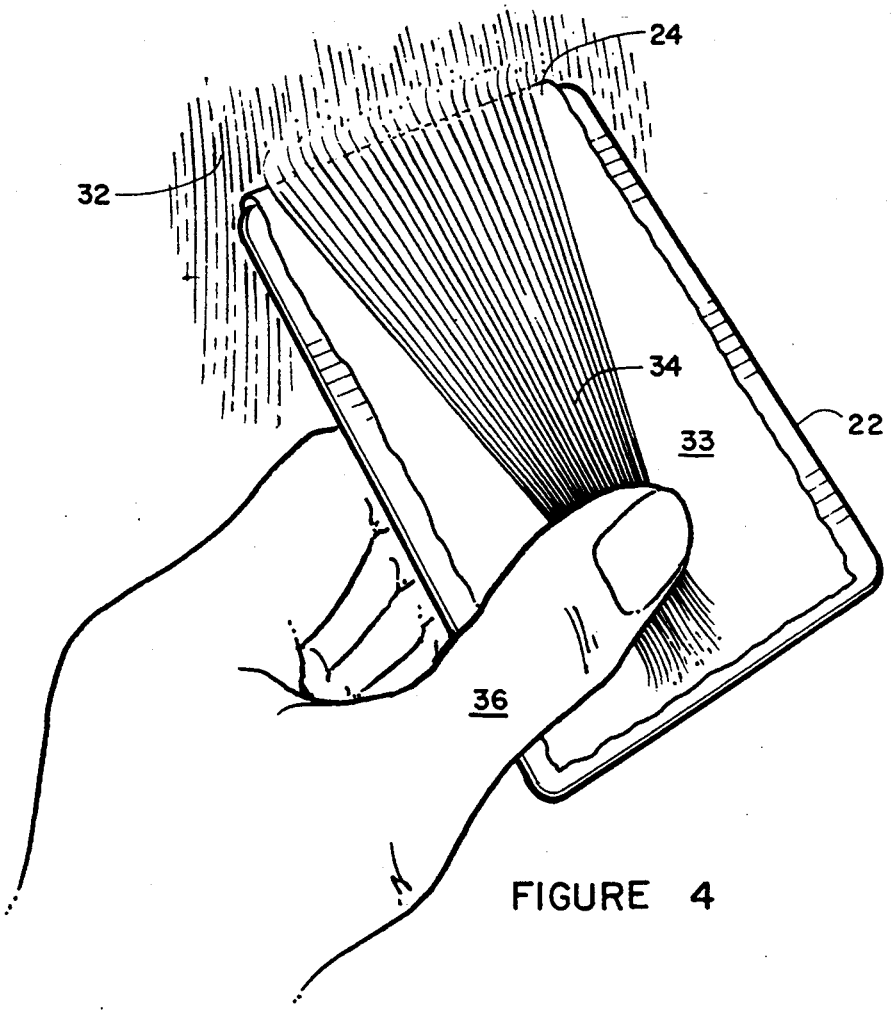
FIG. 4 is a plan view showing how the selected quantity of hair is held on the foil covered color board.

When coloring of selected groups of hair strands is to begin, the operator picks out a selected group of hair strands, typically with a highlighting comb or a rat tailed comb, and places the beveled edge of color board 22 against the scalp 32 as seen in FIG. 4. The selected hair strands 34 are held in place on color board 22, typically by the operator's thumb 36. The required quantity of coloring agent 30 is then picked up by color blade 10 with the operator's other hand.

Figure 5:
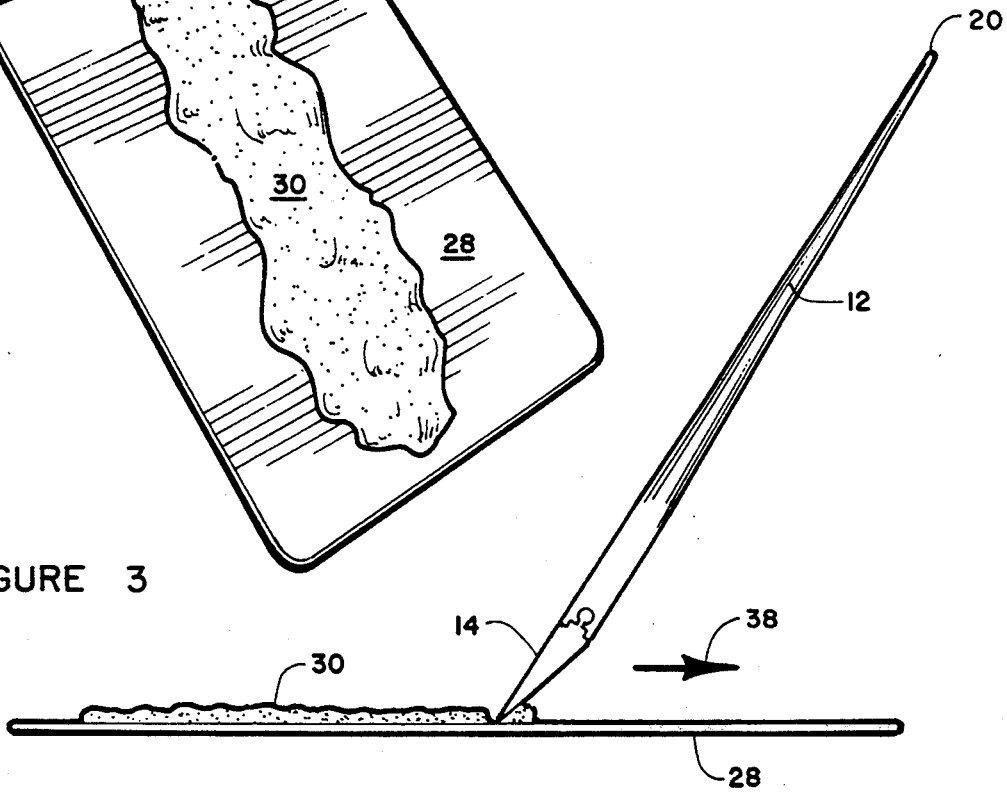
FIG. 5 is a side elevation view showing the pick-up of coloring agent from the palette board.

The manner in which color blade 10 picks up a selected quantity of coloring agent 30 from palette 28 is illustrated in FIG. 5. The blade portion 14 is inserted into the coloring agent at a location near the edge of the layer 30 so as to separate the desired quantity. The blade is moved in the direction of arrow 38 while tilting handle 12 toward the remaining layer 30 so as to wipe and lift the selected quantity of coloring agent, which will form a bead along the edge of blade portion 14.

Figure 6:
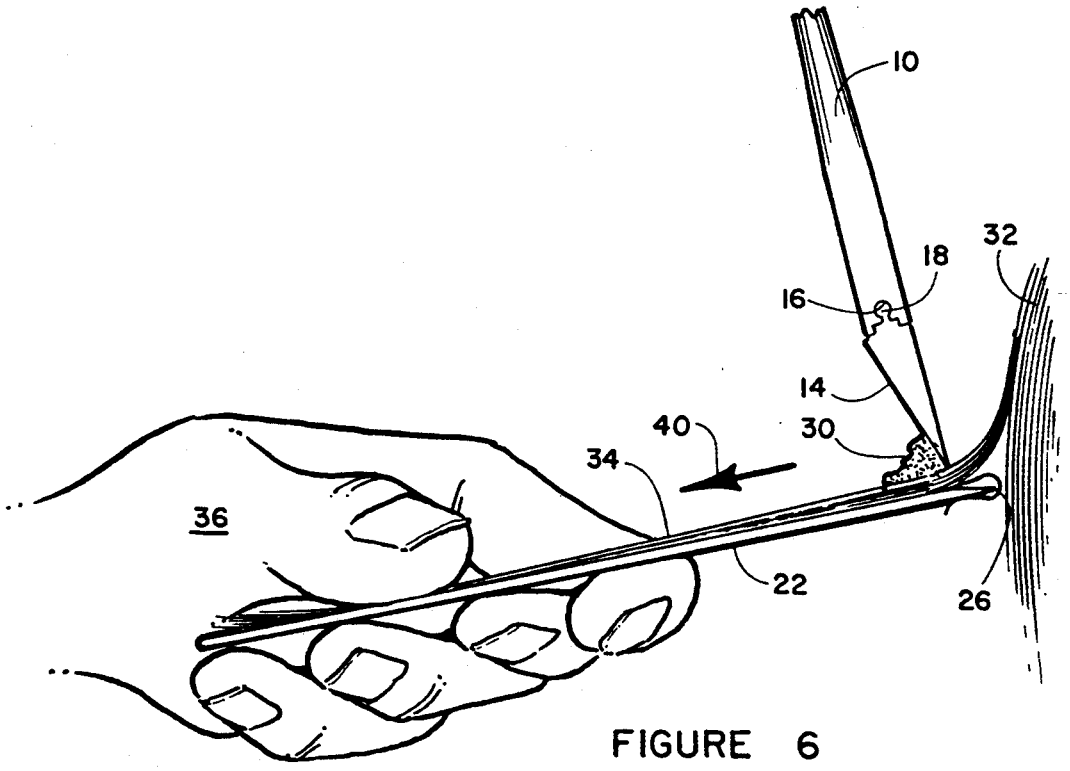
FIG. 6 is a side elevation view showing the blade applying the coloring agent to hair on the foil covered color board.

As seen in FIG. 6, the bead of coloring agent 30 is brought against hair 34 with the clean side of blade portion 14 against the scalp 32, assuring that the root ends of hair 34 are treated without treating adjacent hair or getting color on the scalp itself. Color blade 10 is then smoothly moved across hair 34 in the direction shown by arrow 40. The operator's thumb 36 can be lifted, once the color blade is in contact with the hair since it is no longer necessary to hold hair 34 in place. The coloring agent 30 can be wiped the full length of the hair with color board 22 still in place against scalp 32, or both color blade 10 and color board 22 can be moved together in the direction of arrow 40 once a short distance of the hair has been contacted.

As can be seen, the coloring agent will fully contact all of the hair, with no coloring agent spreading to adjacent hair or the scalp. Where only the tips of a group of hair strands are to be colored, the beveled end 24 of color board 22 can be positioned at the location where coloring is to begin, or the blade 10 carrying the bead 30 of coloring agent can be brought into contact with hair 34 at the desired start location along color board 22, away from scalp 32.

Other applications, variations and ramifications of this invention will occur to those skilled in the art upon reading this disclosure. Those are intended to be included within the scope of this invention, as defined in the appended claims.

I claim:

1. A set of cooperating hair coloring instruments which comprises:

a color blade having a handle and a flexible blade edge at one end, said handle extending away from said blade edge generally perpendicular to said blade edge;

a color palette for holding a layer of viscous hair coloring agent for removal of a selected quantity thereof by said color blade;

a color board for supporting a selected number of strands of hair so that said color blade may be moved along said hair to spread said coloring agent along said color board and said hair strands.

2. The set of cooperating hair coloring instruments according to claim 1 wherein said coloring agent is sufficiently viscous so as to not run when said color palette or color board is tilted.

3. The set of cooperating hair coloring instruments according to claim 1 wherein said color blade has an elongated pointed end opposite said blade edge.

4. The set of cooperating hair coloring instruments according to claim 1 wherein said color board further includes a beveled edge and a sheet of aluminum foil is supported by said color board with one end of said sheet wrapped around said beveled edge.

5. The method of coloring selected groups of hair strands which comprises the steps of:

applying a quantity of at least one color of viscous hair coloring agent to a color palette;

removing a selected quantity of hair coloring agent from said color palette with a flexible edge of a color blade;

supporting a selected number of hair strands on a color board and supporting the color board with one hand;

holding the color blade in the other hand and bringing the viscous hair coloring agent on said color blade into contact with said selected hair at a selected location along the length of said hair with sufficient pressure to flex said flexible edge; and moving said color blade along a selected length of said hair strands to spread said coloring agent over said color board and into contact with said hair along said selected length.

6. The method according to claim 5 including the further step of placing a sheet of aluminum foil on said color board prior to placing the selected hair strands thereon.

7. The method according to claim 6 wherein said color board has a beveled edged and including the step of wrapping an edge of said foil over said beveled edge.

8. The method according to claim 7 wherein said beveled edge is brought into contact with the scalp prior to said placing of selected hair strands on said board.

9. The method according to claim 5 wherein said coloring agent is sufficiently viscous to permit any desired orientation of said color blade during application of said coloring agent to the selected hair.

10. The method of coloring selected groups of hair strands which comprises the steps of:

(a) applying a layer of hair coloring agent to a color palette;

(b) removing a selected quantity of hair coloring agent from said color palette with a flexible edge of a color blade;

(c) placing a sheet of flexible foil on a color board;

(d) wrapping an end of said foil around an edge of said color board;

(e) supporting a selected group of hair strands on said color board with the foil wrapped end in contact with a scalp along a line;

(f) bringing the hair coloring agent on said color blade into contact with said selected hair at a selected location along the length of said hair;

(g) moving said color blade along a selected length of said hair strands to bring said coloring agent into contact with said hair along said selected length; and (h) repeating steps (c) through(g) at least one additional time with additional groups of hair strands.

11. The method according to claim 10 wherein said foil is wrapped around each group of hair strands and separated from said color board after said coloring agent is applied.

12. The method according to claim 10 where different groups of strands are treated with at least two differently colored coloring agents.

13. The method according to claim 10 wherein said foil is aluminum foil.

14. The method according to claim 10 wherein said coloring agent is sufficiently viscous to permit any desired orientation of said color blade during application of said coloring agent to the selected hair.

15. A set of cooperating hair coloring instruments which comprises:

a color blade having a handle and an at least slightly flexible blade edge at one end;

said color blade comprising a rigid handle portion and means for releasably securing a flexible blade portion to said handle;

a color palette for holding a layer of hair coloring agent for removal of a selected quantity thereof by said color blade;

a color board for supporting a selected number of strands of hair so that said color blade may be moved along said hair to apply said coloring agent to said hair strands.

16. The set of cooperating hair coloring instruments according to claim 15 wherein said means for releasably securing includes a transverse channel along a handle portion edge, said channel having a circular cross section and said blade portion has a transverse bead adapted to tightly fit in said channel.

* * * * *